US011969636B1

(12) United States Patent
Norris et al.

(10) Patent No.: US 11,969,636 B1
(45) Date of Patent: Apr. 30, 2024

(54) TRAINING DEVICE FOR STICK AND RACKET SPORTS

(71) Applicant: Nicolas Norris, Boulder, CO (US)

(72) Inventors: Nicolas Norris, Boulder, CO (US); Bradford Norris, Boulder, CO (US)

( * ) Notice: Subject to any disclaimer, the term of this patent is extended or adjusted under 35 U.S.C. 154(b) by 0 days.

(21) Appl. No.: 18/219,502

(22) Filed: Jul. 7, 2023

(51) Int. Cl.
*A63B 69/00* (2006.01)
*A63B 59/20* (2015.01)
*A63B 102/02* (2015.01)
*A63B 102/14* (2015.01)

(52) U.S. Cl.
CPC ..... *A63B 69/00* (2013.01); *A63B 59/20* (2015.10); *A63B 2102/02* (2015.10); *A63B 2102/14* (2015.10)

(58) Field of Classification Search
CPC ..... A63B 59/20; A63B 2102/14
See application file for complete search history.

(56) References Cited

U.S. PATENT DOCUMENTS 7,309,299 B2 * 12/2007 Pezzato ..... A63B 49/11 473/546
D581,475 S * 11/2008 Dickie ..... D21/724
7,736,252 B2 * 6/2010 Tucker, Jr. ..... A63B 59/20 D21/724
D807,451 S * 1/2018 Paquette ..... D21/724
10,252,126 B2 * 4/2019 Paquette ..... A63B 59/20
2004/0180738 A1 * 9/2004 Morrow ..... A63B 59/20 473/513
2005/0282667 A1 * 12/2005 Morrow ..... A63B 60/08 473/513
2006/0183575 A1 * 8/2006 Montano ..... A63B 49/03 473/513
2007/0129186 A1 * 6/2007 Appleton ..... A63B 60/06 473/513
2008/0305898 A1 * 12/2008 Lamson ..... A63B 60/00 428/36.9
2009/0239689 A1 * 9/2009 Baxter ..... A63B 60/10 138/114
2010/0267501 A1 * 10/2010 Tucker, Jr. ..... A63B 59/20 473/513
2013/0005517 A1 * 1/2013 Winningham ..... A63B 59/20 473/513
2014/0323249 A1 * 10/2014 Miceli ..... A63B 59/20 473/513
2015/0328511 A1 * 11/2015 Luehrsen ..... A63B 59/20 428/34.1
2022/0062724 A1 * 3/2022 Sedlack ..... A63B 59/20

* cited by examiner

*Primary Examiner* — Joshua T Kennedy
(74) *Attorney, Agent, or Firm* — Will Hunziker

(57) ABSTRACT

A practice and/or training device for building fine motor skills for sports that use a stick, racket, or paddle with a ball. The device is shaped to resemble the sport's original racket/stick/paddle shape (e.g., tennis racket or lacrosse stick) but is not designed for competition in mind. Instead, the device provides a variety of skill building features for the user to practice ball control skills including rails, tracks, exaggerated surface areas, scoops, ridges, grooves, ramps, undulations, textures (bumps, serrations, etc), holes, platforms, cups, and springy meshes. The combination of these features on the device allows the user to practice combinations of "freestyle" skills and tricks to improve hand eye coordination using the device with a ball.

15 Claims, 8 Drawing Sheets

TRAINING DEVICE FOR STICK AND RACKET SPORTS

BACKGROUND OF THE INVENTION

1. Field of the Invention

The present invention is in the technical field of sticks, rackets, and paddles designed for sports. More particularly, the present invention pertains to the field of specifically designed heads and handles for stick, racket, and paddle equipment for contact juggling balls.

2. Description of Related Art

Presently there are numerous videos of professionals who balance balls on their sticks, rackets, or paddles and then perform various tricks with the balls; however, no one has specifically designed handles and heads of stick, racket, and paddle sporting equipment for contact juggling balls and ball handling. The present disclosure presents a number of novel features which can be built into the handles and heads of various sport equipment making them more versatile for contact juggling balls thereon by providing tracks for a ball to roll upon the equipment and balance spots designed to hold a ball in place when balanced upon the equipment, when used in conjunction with each other, a number of otherwise impossible "freestyle" tricks and ball handling skills can be performed by using the modified equipment.

SUMMARY

The scope of the present invention is defined solely by the appended claims and detailed description of a preferred embodiment and is not affected to any degree by the statements within this summary. Generally, the disclosure is of a practice and/or training device for building fine motor skills for sports that use a stick, racket, or paddle with a ball. The device is shaped to resemble the sport's original stick/racket/paddle shape (e.g., tennis racket, lacrosse stick, table tennis paddle) but is not designed for competition in mind as the sticks, rackets, and paddles would likely not meet regulations on standardization. Instead, the device provides a variety of skill building features for the user to practice ball control skills including rails, tracks, exaggerated surface areas, scoops, ridges, grooves, ramps, undulations, textures (bumps, serrations, etc), holes, platforms, cups, and springy meshes. The combination of these features on the device allows the user to practice combinations of "freestyle" skills and tricks to improve hand eye coordination using the device with a ball.

OBJECTS AND ADVANTAGES

The present device can provide a number of advantages depending on the particular aspect, embodiment, and/or configuration. None of the objects or advantages that follow must be entirely satisfied as they are non-exclusive alternatives and at least one of the following objects is met; accordingly, several objects and advantages of the present device are:

(a) to provide a rail to allow a ball to roll around the periphery of a stick, racket, or paddle;

(b) to provide various balance spots on a racket, stick, or paddle for stalling or catching a ball;

(c) to provide a ramp at the end of said rails for flipping a ball into the air;

(d) to provide enlarged surfaces on the head of said stick or racket for scooping up, catching, balancing, and manipulating a ball;

(e) to provide a net, strings, mesh; or similar wire, string, or cord with various elasticity and tension for improving bounce when handling a ball;

(f) to provide various textures on a stick, racket, or paddle to manipulate the speed of a ball on said surface.

These and other objectives and advantages of the instant invention will become apparent from the following description taken in conjunction with the accompanying drawings.

BRIEF DESCRIPTION OF THE DRAWINGS

Various embodiments are described herein with reference to the following Drawings. Not all alternatives and options are shown in the Drawings and, therefore, the Claims are not limited in scope to the content of the Drawings. Elements in the several figures are illustrated for simplicity and clarity and have not necessarily been drawn to scale. Also, common, but well-understood elements that are useful or necessary in commercially feasible embodiments are often not depicted to facilitate less obstructed views of these various embodiments of the present disclosure.

Figures

Corresponding reference characters indicate corresponding components throughout the several figures of the Drawings.

REFERENCES

Figure 1:
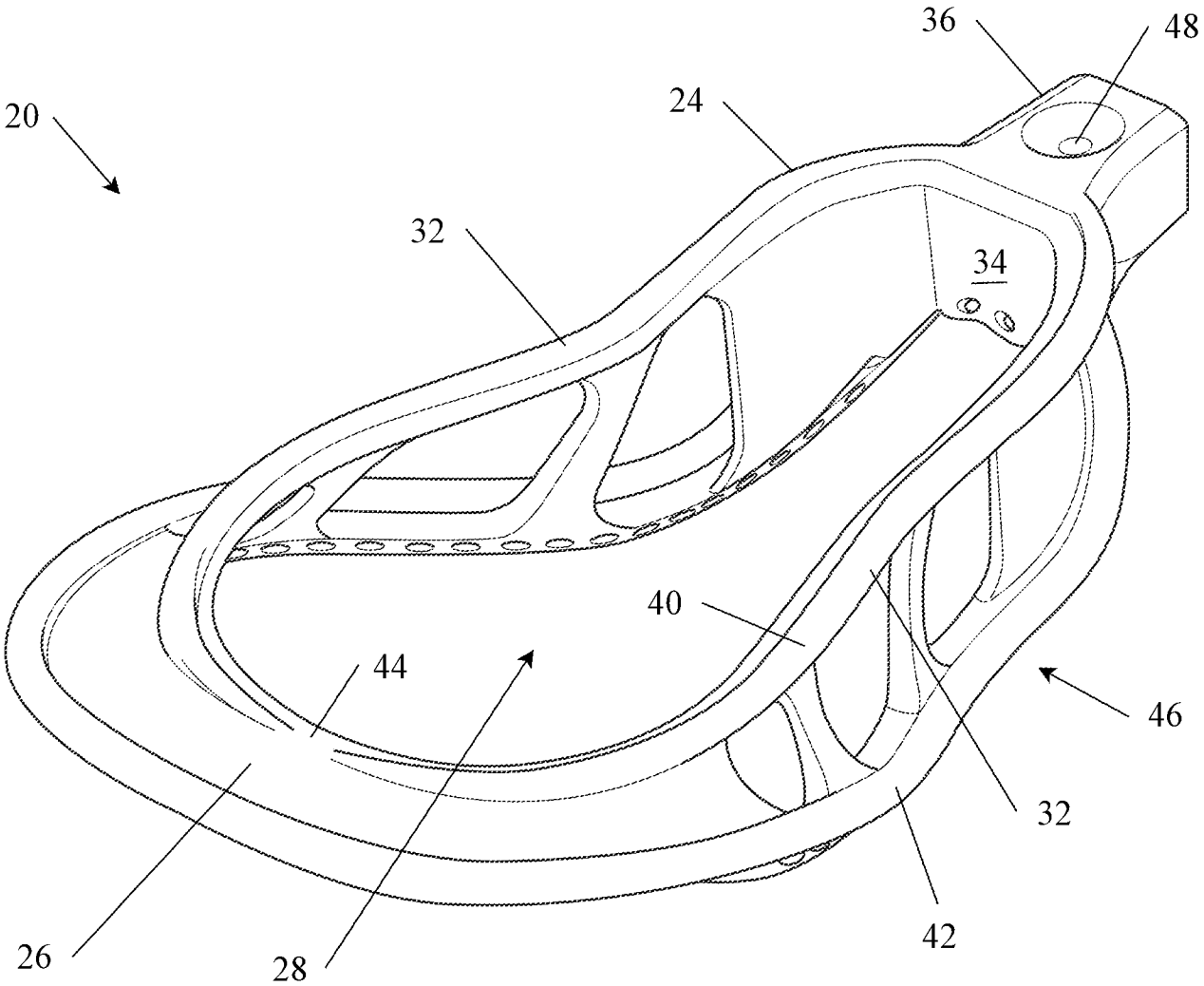
FIG. 1 illustrates a perspective view of a head of a lacrosse stick, in accordance with an embodiment of the present disclosure.

20 Training Device for Stick, Racket, and Paddle Sports
22 Handle
24 Head
26 Scoop Balance Spot
28 Pocket
30 Mesh
32 Sidewalls
34 Ball Stop
36 Throat
40 First Rail
42 Second Rail

44 Rail Pass Through
46 Concavity Balance Spot
48 Cup Balance Spot
50 Ramp Balance Spot
52 Tactile Texture Pad Balance Spot
54 Base of Training Device for Stick and Racket Sports
56 Stop Balance Spot
58 Face of Racket or Paddle
60 A Net, Strings, Mesh; or Similar Wire, String, or Cord with Various Elasticity and Tension

DETAILED DESCRIPTION

The following description is not to be taken in a limiting sense but is made merely for the purpose of describing the general principles of exemplary embodiments, no limitation of the scope of the invention is thereby intended. The phrases: "in one embodiment," "in an embodiment," and similar language throughout this specification may, but do not necessarily, all refer to the same embodiment. The phrases "at least one," "one or more," and "and/or" are open-ended expressions that are both conjunctive and disjunctive in operation. The terms "a" or "an" entity refers to one or more of that entity. As such, the terms "a" (or "an"), "one or more" and "at least one" can be used interchangeably herein. It is also to be noted that the terms "comprising," "including," and "having" can be used interchangeably and are understood to mean open sets of options; such as, the elements A+B and any additional element C. The described features, structures, methods, steps, or characteristics of the present disclosure may be combined in any suitable manner in one or more embodiments. In other instances, well-known structures, materials, or operations are not shown or described in detail to avoid obscuring aspects of the present disclosure. Further, all numbers expressing dimensions, physical characteristics, and so forth, used in the specification and claims are to be understood as being modified in all instances by the term "about".

Regarding the illustrations, as used in the following description, the terms "horizontal", "vertical", "left", "right", "up" and "down", as well as adjectival and adverbial derivatives thereof (e.g., "horizontally", "rightward", "upwardly", etc.), simply refer to the orientation of the illustrated structure as the particular drawing or figure faces the reader. Similarly, the terms "inwardly" and "outwardly" generally refer to the orientation of a surface relative to its axis of elongation, or axis of rotation, as appropriate.

For the purposes of promoting an understanding of the principles of the present invention, reference will now be made to the embodiments illustrated in the drawings and specific language will be used to describe the same.

FIGS. 1 through 9 illustrate a training device for stick, racket, and paddle sports (20), the training device is intended to look similar to the shape and design of the stick or racket used for sports that use balls, but with additional design elements that allow a user to manipulate, train, juggle, flip, stall, roll and scoop a ball in ways not possible with regulation sporting equipment. These additional elements allow the user to train their ball handling skills at low speed, delicate, manipulations. The additional elements can be incorporated into any stick or racket for any stick or racket sport using balls, including, but not limited to: lacrosse, tennis, racquetball, squash, pickleball, table tennis, beach paddle ball, golf, speed-ball, Basque pelota, paddle, or any other sport that uses a racket, stick, or paddle. In this disclosure a racket may also mean a paddle, such as those used for table tennis and pickle ball.

Figure 4:
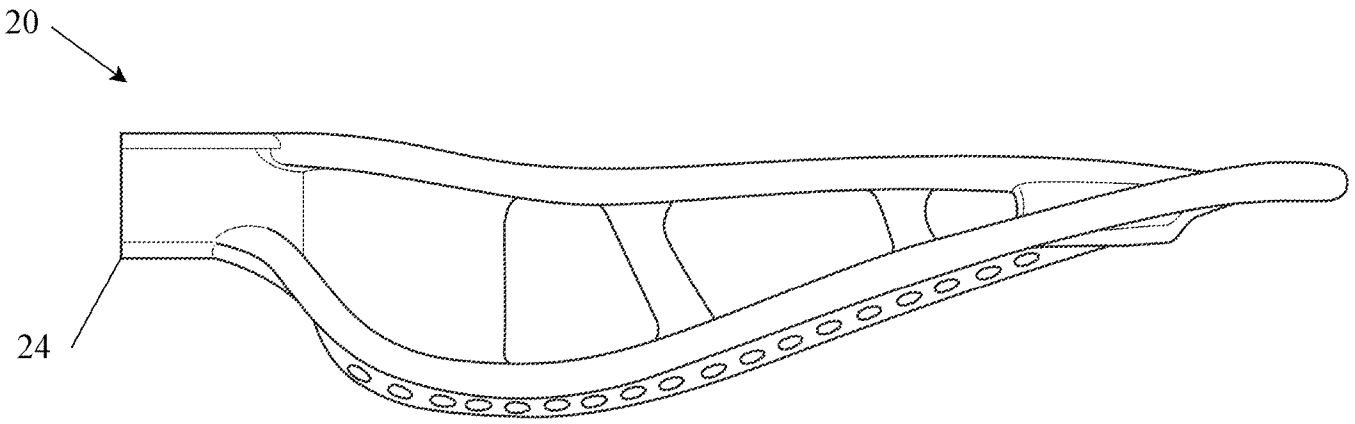
FIG. 4 illustrates a right-side view of a head of a lacrosse stick, in accordance with an embodiment of the present disclosure.
Figure 5:
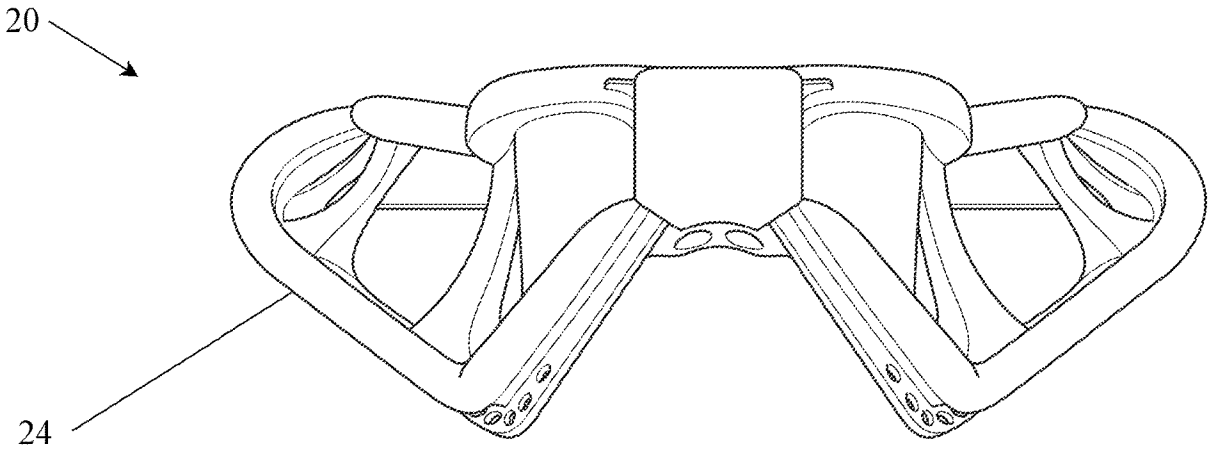
FIG. 5 illustrates a rear view of a head of a lacrosse stick, in accordance with an embodiment of the present disclosure.
Figure 6:
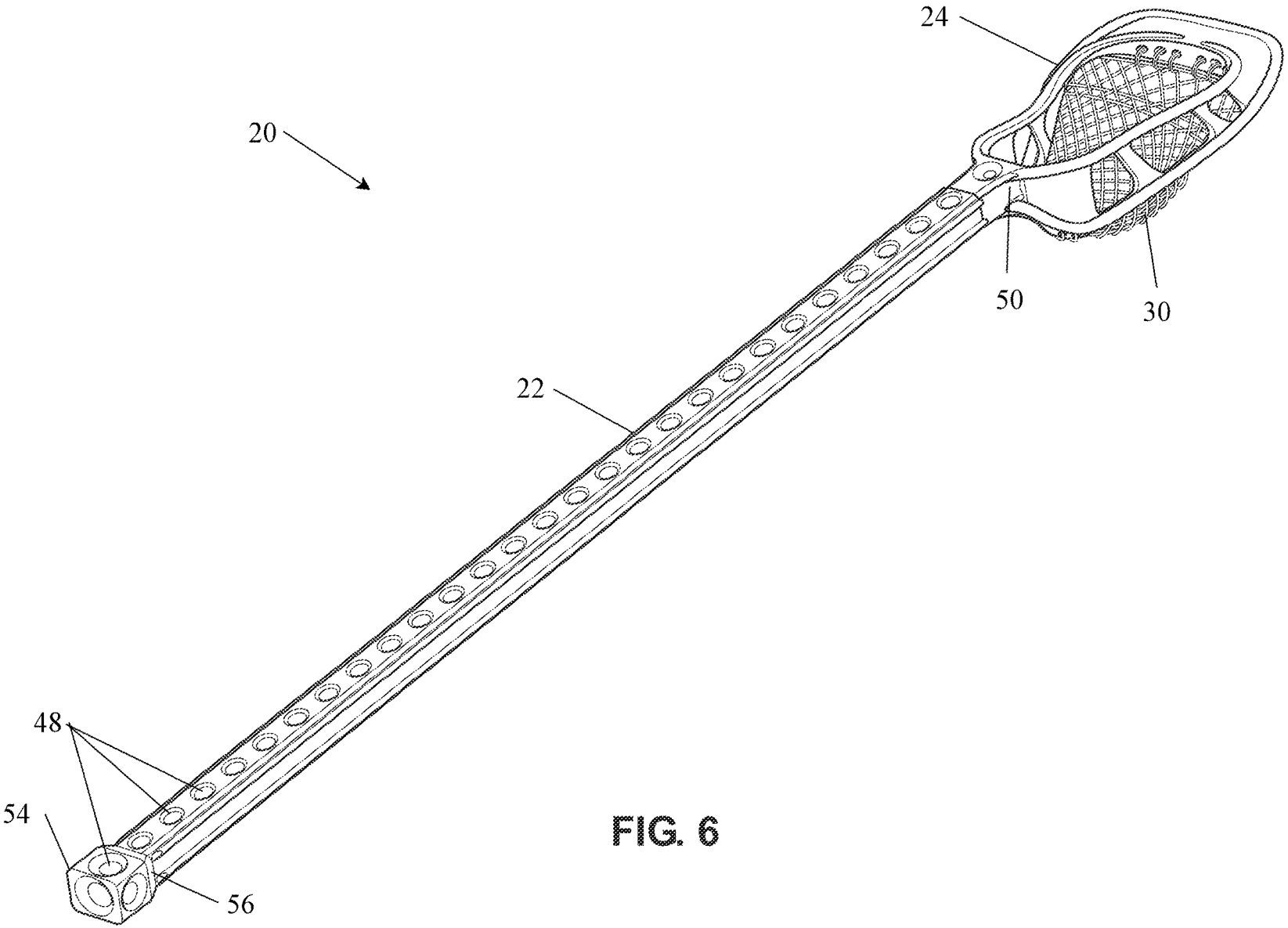
FIG. 6 illustrates a lacrosse stick with a mesh, in accordance with an embodiment of the present disclosure.
Figure 7:
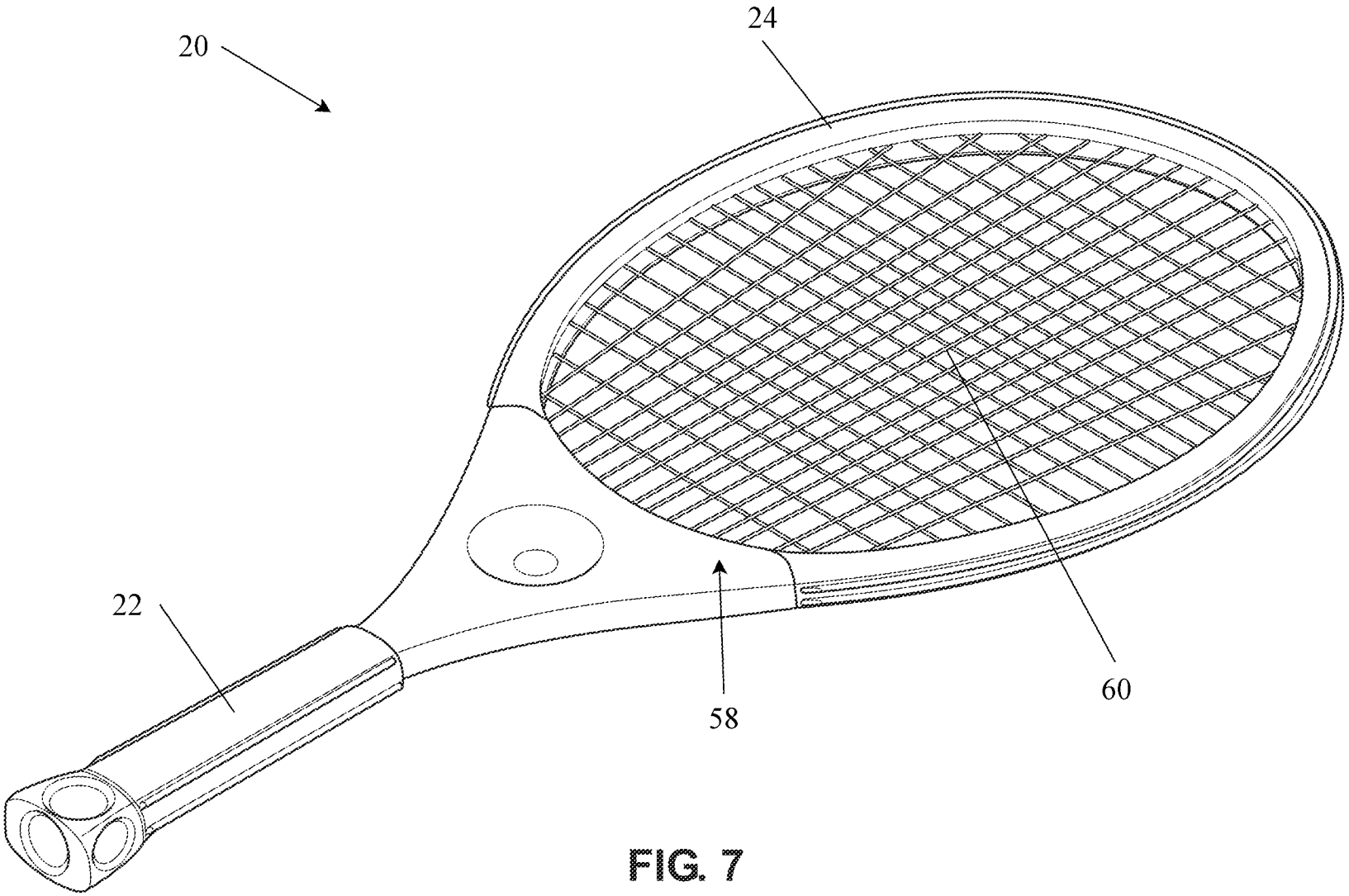
FIG. 7 illustrates a perspective view of a tennis racket or paddle with a net, strings, mesh; or similar wire, string, or cords, in accordance with an embodiment of the present disclosure.
Figure 8:
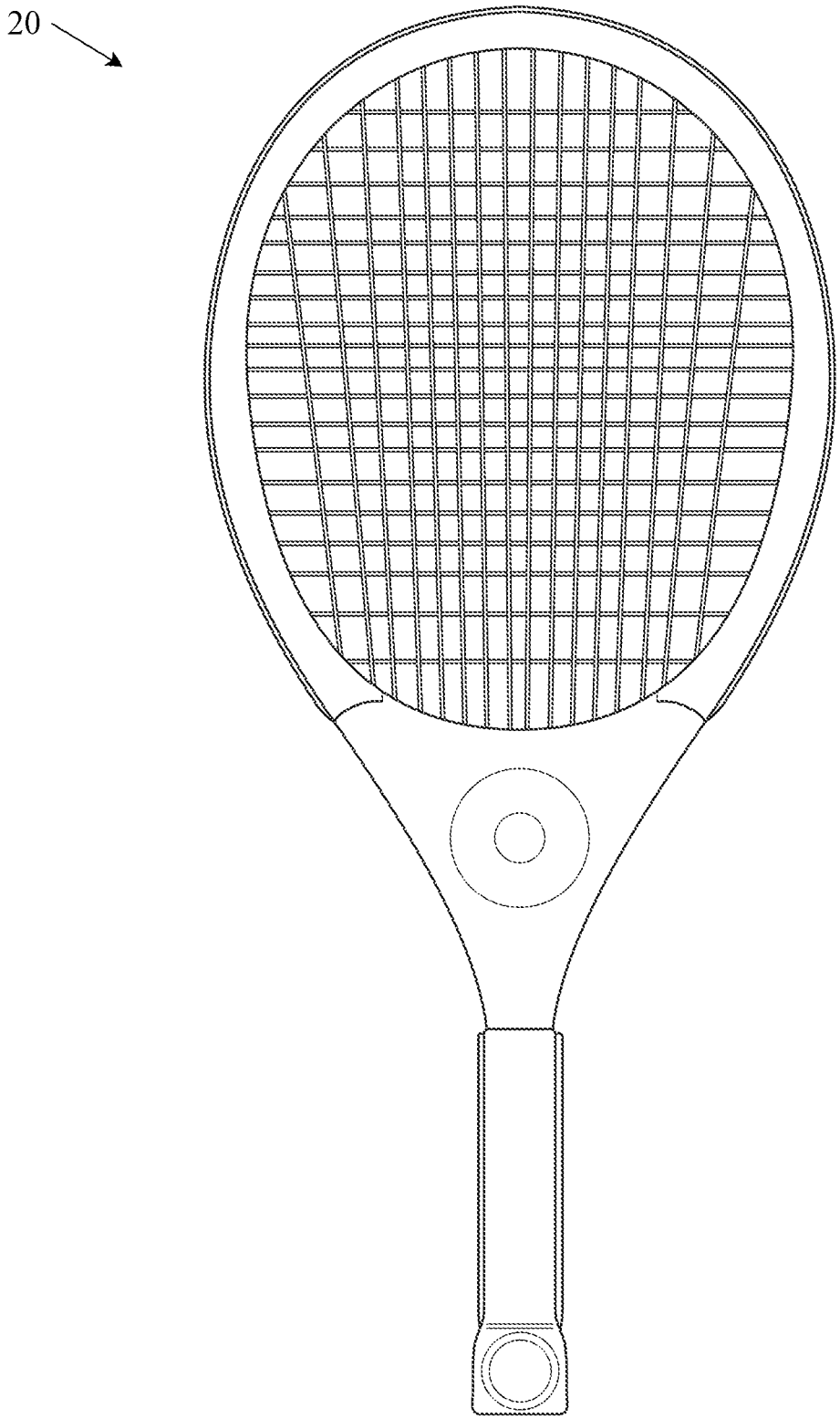
FIG. 8 illustrates a front view of a tennis racket or paddle, in accordance with an embodiment of the present disclosure.

The embodiments of a training device for stick, racket, and paddle sports (20) disclosed is shown incorporated into a lacrosse stick and a lacrosse stick head in FIGS. 1 through 5 and in a tennis racket in FIGS. 6 through 8, but the principals of how the additional elements work are the same and the application of those elements is the same for all stick, racket, and paddle sporting equipment which have a handle (22) and a head (24). The training device for stick, racket, and paddle sports (20) may be made of any material suitable for its purpose and the method of construction would be obvious to anyone of ordinary skill in the art.

All the embodiments of a training device for stick, racket, and paddle sports (20) may comprise a first rail (40) and a second rail (42) that may extend the entire a portion or all of the periphery of the device (20). The first (40) and second rail (42) are designed such that a ball used for the sport the sporting equipment is used for may roll between the two rails unimpeded. Said rails may be narrow to the point of an edge or be rounded where they contact a ball. Said rails may also rise, fall, widen, narrow, or curve to increase or diminish the ball's momentum and affect the trajectory of the ball due to its inertia, gravity, and the force applied to the ball with the sporting equipment by a user. The two rails may also cause the ball to come into contact with the device itself allowing the device to slow, stop, or change the direction of the ball.

Said training device for stick, racket, and paddle sports (20) and said first (40) and said second rails (42) may have surfaces comprising varying tactile textures, such as, but limited to: stickiness/slipperiness, roughness, hardness, moistness/dryness; that cause more or less friction, increasing or diminishing the friction between the ball and the device. The textures may comprise, but are not limited, using different materials such as fabric, wool, cloth, or metal; using different surface treatments, such as tacky or slick treatment; or the surface may be formed differently such as with bumps or serrations. Said training device for stick, racket, and paddle sports (20) and said first (40) and said second rails (42) may also comprise combinations of tactile textures for varying effects depending on where the ball is located on the device.

Certain locations on the embodiments of a training device for stick, racket, and paddle sports (20) are designed to halt the moment of a ball and within this disclosure are called "balance spots" as they allow the user to "balance" the ball at that "spot" on the device. Balance spots can be called, but are not limited to: scoops, stops, cups, concavities, pinch points, and pads depending on their physical shapes and tactile textures. Scoops tend to have four primary sides and are designed to divert the moment of a ball into a more secure balance spot. Stops are also primarily four sided but are designed to arrest the momentum of a ball at that balance spot. Cups are spherical caps that create a balance spot. Concavities arrest the momentum of a ball but do not fall into the prior definitions. Pads are any of the above, that also feature tactile texture elements to arrest the momentum of a ball. The balance spots are typically located around a head of racket, stick, or paddle; where said head meets a handle or stick; on a base of a handle or stick; and if the stick or handle is long enough such that said balance spots do not impede handling of a stick or handle, then along one or more sides of a stick or handle.

Said first and said second rails may also extend outward from a training device for stick, racket, and paddle sports (20) forming a ramp for launching a ball; said ramps are typically located at, or near, the ends of the rails to achieve maximum leverage and velocity and are naturally concavity balance Spots as described above. Additionally, where a racket, stick, or paddle comprises a net, strings, mesh; or similar wire, strings, or cords; said elements may be made of a various elastic materials and tensions such that a ball may bounce more or less efficiently off of said net, strings, mesh; or similar wire, strings, or cords. Said net, strings, mesh; or similar wire, strings, or cords may be removable and may have adjustable tension after installed.

Turning now to the drawings, FIG. 1 illustrates a perspective view of a head (24) of a training device for stick, racket, and paddle sports. In this embodiment it is a head of a lacrosse stick. The standard elements of a lacrosse stick head are a scoop (26); a pocket (28), which is enclosed by a mesh (30—shown in FIG. 5); sidewalls (32); a ball stop (34); a throat (36). A handle (22) for a training device for stick, racket, and paddle sports is shown in FIGS. 6 through 9. The changes to these standard elements may varying in degree in different embodiments according to the skill level of the user.

When juggling and ball handling using the training device for stick, racket, and paddle sports (20), especially when first beginning the ball is dropped often and picking it up off the ground is a constant struggle. As seen in FIG. 1, the scoop (26) has been enlarged and curved to make picking the ball off the ground easier while also creating a balance spot on the scoop. For other stick, racket, and paddle sports there may not be a scoop on the tip of the head (24) already, in that case one may be added. Said first rail (40) and said second rail (42) may begin at the tip of the racket head allowing the user to simultaneously pick up a ball from the ground and place the ball directly onto said first and second rails. This has the added benefit of allowing the user to immediately handle the ball from the ground along the rails. There may also be one or more rail pass throughs (44) which are indentations in one or both of the rails allowing the ball to pass over one of the rails and into a pocket (28) of a netted device such as a lacrosse sick, or onto a face of a paddle or racket.

In preferred embodiments lacrosse stick heads have one rail pass through on the head into the pocket, while racket or paddle would have multiple rail pass throughs (44) allowing the user to roll the ball off of the face (58 shown in FIG. 7) at multiple locations and onto the rail or over to the other side of the racket or paddle face.

In the embodiment shown in FIG. 1, the rails curve around to the sidewalls (32) and then widen, slowing the ball into a concavity balance spot (46). Also shown is a cup balance spot (48) located on the throat (34). In alternate embodiments, there may be multiple balance spots on each side of the throat.

Figure 2:
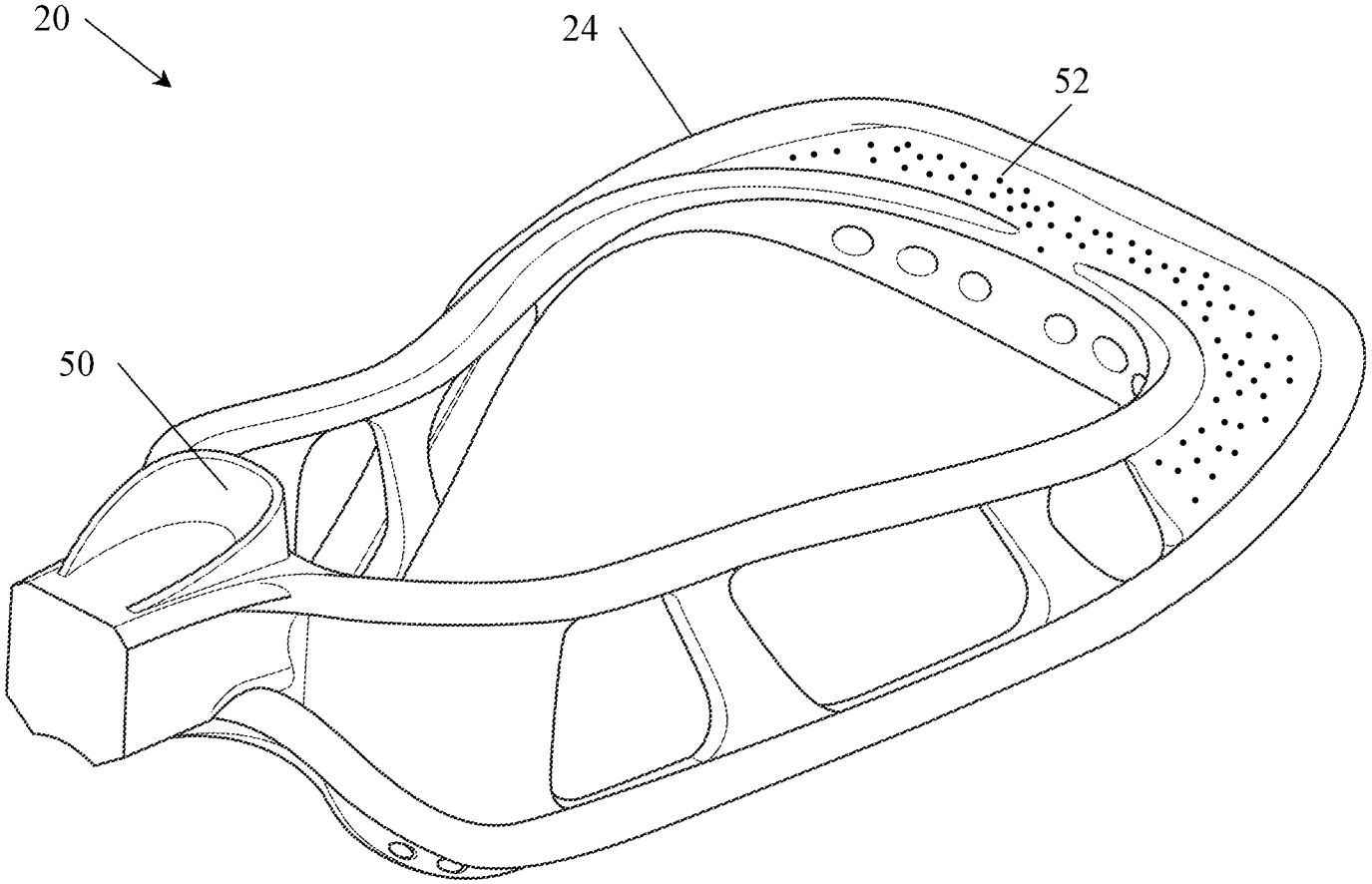
FIG. 2 illustrates a perspective view of a head of a lacrosse stick with a scoop where the head meets the handle, in accordance with an embodiment of the present disclosure.

FIG. 2 illustrates a perspective view of a head of a lacrosse stick with a scoop where the head meets the handle, in accordance with an embodiment of the present disclosure. In FIG. 2 the cup balance spot (48) has been replaced with a scoop balance spot that also acts as a ramp (50) when connected with said first rail and said second rails extending from the handle (22) or stick of a stick, racket, or paddle sporting device, as described above. FIG. 2 also illustrates a tactile texture (52) applied to the training device for stick and racket sports (20) creating a pad balance spot on the scoop balance spot. Importantly, as with all techniques for creating balance spots, they may be applied anywhere on the device.

Figure 3:
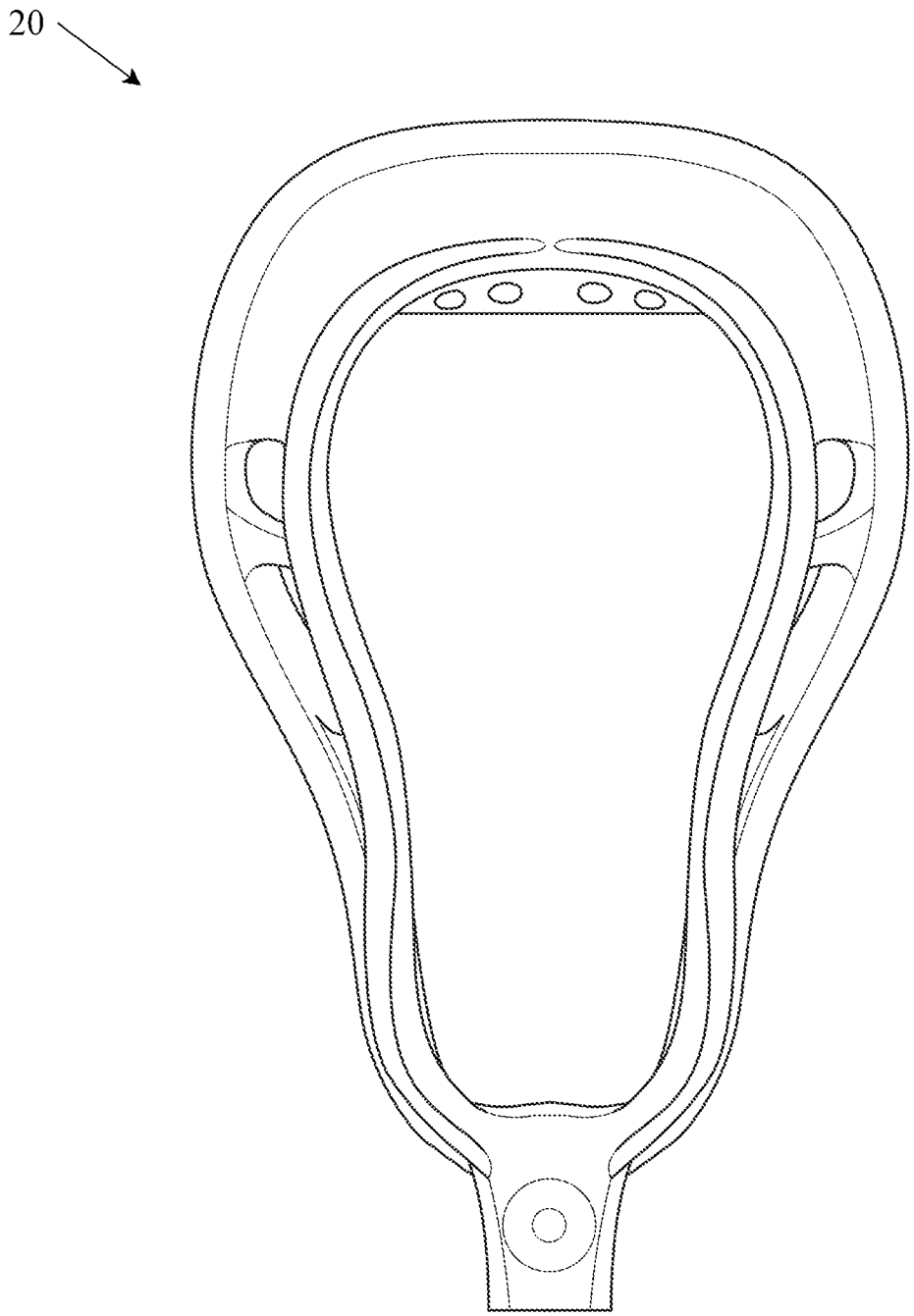
FIG. 3 illustrates a bottom view of a head of a lacrosse stick, in accordance with an embodiment of the present disclosure.

FIGS. 3 through 5 illustrates a bottom view, a right-side view, and a bottom view respectively of an embodiment of a head of a lacrosse stick for better understanding of the curvature of the rails and balance spots.

FIG. 6 illustrates stick, racket, and paddle sports (20) shown in this embodiment as a lacrosse stick, additionally showing a handle (22) a net (30) portions of a lacrosse stick. As seen in this embodiment, the handle (or stick) (22) has multiple cup balance spots (48) along the handle and in each available direction at the base (54). The cup balance spots could alternatively be any of the balance spots referred to above, such as scoops, stops, concavities, or ramps. The base (54) also acts as a stop balance spot (56) when a ball is rolling along the rails of the stick (32). Where the rails of a handle (22) of a training device for stick, racket, and paddle sports (20) meet the head (24) and base (54) are natural locations for ramp balance spots (50) as they give the user maximum leverage and velocity for handling the ball.

Figure 9:
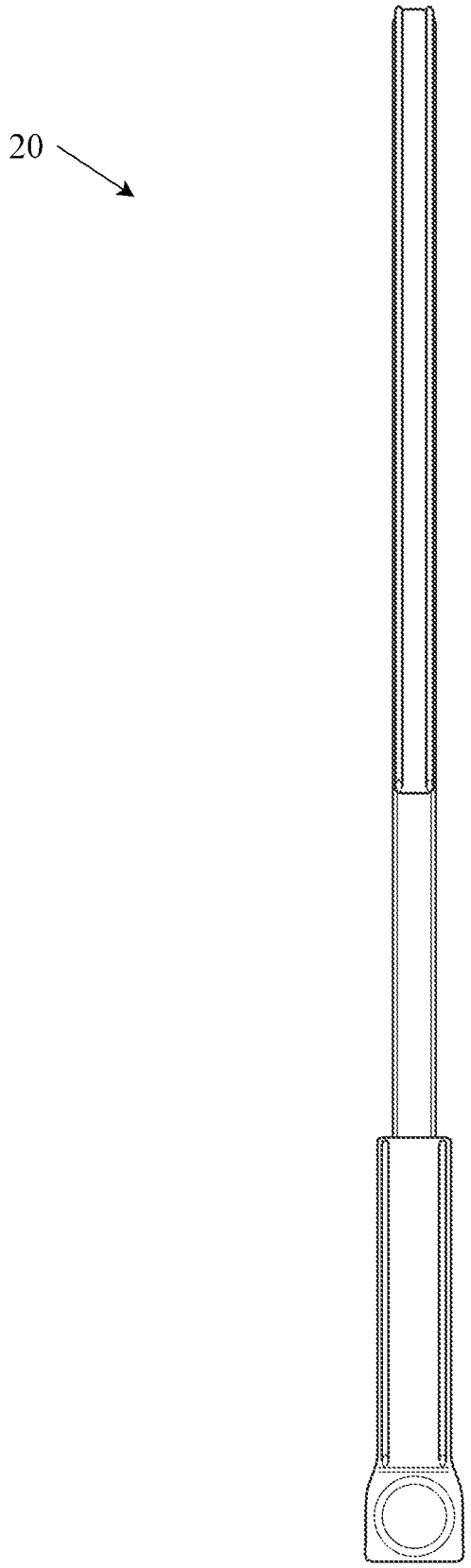
FIG. 9 illustrates a left-side view of a tennis racket or paddle, in accordance with an embodiment of the present disclosure.

FIGS. 7, 8, and 9 illustrates perspective, front, and left side views respectively of a racket or paddle embodiment of a training device (20), shown here as a tennis racket; featuring all the same additional elements shown in the lacrosse stick embodiments shown in FIGS. 1 through 5, with the addition of a face (58) instead of a pocket. Additionally, the racket or paddle may have a net, strings, mesh; or similar wire, string, or cord with various elasticity and tension (60) for improving bounce when handling the ball The scope of the present disclosure fully encompasses other embodiments which may become obvious to those skilled in the art, and is to be limited, accordingly, by nothing other than the appended claims. All structural and functional equivalents to the elements of the above-described preferred embodiment and additional embodiments as regarded by those of ordinary skill in the art are hereby expressly incorporated by reference and are intended to be encompassed by the present claims. Furthermore, no element, component, or method step in the present disclosure is intended to be dedicated to the public regardless of whether the element, component, or method step is explicitly recited in the claims.

What is claimed is:

1. A training device for stick, racket, and paddle sports comprising:

a head;

a throat;

a scoop with a front and a back;

a first rail;

a second rail; and wherein said first and said second rails define an inner and outer periphery of an upper face of said head such that a pathway defined by the first and second rails extend from said throat to a radially enlarged portion of the front of said scoop to form a continuous pathway to allow a ball to roll on said first and said second rails around the entire periphery of said head from a first side of said throat to a second opposite side of said throat.

2. The device of claim 1, wherein said space between said first rail and said second rail on said scoop has been enlarged in relation to the scoop of said sporting equipment said device appears similar to.

3. The device of claim 1, wherein said first rail or said second rail on said head further comprise a rail pass through allowing a ball rolling on said first rail and said second rail to roll off said rails and into a pocket.

4. The device of claim 1, wherein said throat further comprises a balance spot.

5. The device of claim 4, wherein said throat with a balance spot comprises a ramp balance spot.

6. The device of claim 1, further comprising tactile texture balance points wherein the material or texture is differentiated to increase friction and hold on a ball.

7. The device for of claim 1, further comprising:

a net, strings, mesh; or similar wire, string, or cordage; and wherein said net, strings, mesh; or similar wire, string, or cordage provides either more or less bounce than said sporting equipment said device appears similar to.

8. The device of claim 7, wherein said net, strings, mesh; or similar wire, string, or cordage further comprises adjustable tension while mounted to said training device.

9. The device of claim 1, wherein said device is similar to a lacrosse stick.

10. A training device for stick, racket, and paddle sports, comprising:

a handle with a base;

a head; a throat; a scoop with a front and a back; a first rail;

a second rail; and wherein said first and said second rails define an inner and outer periphery of an upper face of said head such that a pathway defined by the first and second rails extend from said throat to a radially enlarged portion of the front of said scoop to form a continuous pathway to allow a ball to roll on said first and said second rails around the entire periphery of said device from a first side of said base of said handle to a second opposite side of said base of said handle.

11. The device of claim 10, further comprising a ramp balance point where said handle meets said head.

12. The device of claim 10, wherein a base of said handle further comprises a balance point.

13. The device of claim 12, wherein said base of said handle further comprises more than one balance point.

14. The device of claim 12, further comprising a ramp balance point where said handle meets said base.

15. The training device for stick, racket, and paddle sports of claim 10, further comprising multiple concavity balance points along opposing sides of said handle.

* * * * *